US010327319B1

(12) United States Patent
Morrisroe

(10) Patent No.: US 10,327,319 B1
(45) Date of Patent: Jun. 18, 2019

(54) COUNTERFLOW SAMPLE INTRODUCTION AND DEVICES, SYSTEMS AND METHODS USING IT

(71) Applicant: PERKINELMER HEALTH SCIENCES, INC., Waltham, MA (US)

(72) Inventor: Peter Morrisroe, New Milford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 15/603,766

(22) Filed: May 24, 2017

Related U.S. Application Data

(60) Provisional application No. 62/341,225, filed on May 25, 2016.

(51) Int. Cl.

| | |
|---|---|
| ***H01J 49/00*** | (2006.01) |
| ***H05H 1/00*** | (2006.01) |
| ***H05H 1/46*** | (2006.01) |
| ***H01J 49/40*** | (2006.01) |
| *H05H 1/24* | (2006.01) |

(52) U.S. Cl.
CPC ..... *H05H 1/0037* (2013.01); *H01J 49/408* (2013.01); *H05H 1/46* (2013.01); *H05H 2001/245* (2013.01); *H05H 2001/2443* (2013.01); *H05H 2001/466* (2013.01); *H05H 2001/469* (2013.01); *H05H 2001/4652* (2013.01)

(58) Field of Classification Search
CPC ..... H05H 1/00; H05H 1/0037; H05H 1/24; H05H 1/26; H05H 1/34; H01J 49/00; H01J 49/0212; H01J 49/18; H01J 49/105
USPC ..... 250/281, 282, 288
See application file for complete search history.

(56) References Cited

U.S. PATENT DOCUMENTS

| | | | | |
|---|---|---|---|---|
| 5,223,711 | A * | 6/1993 | Sanderson | H01J 49/025 250/281 |
| 5,731,872 | A * | 3/1998 | Falk | G01N 21/73 356/316 |
| 2005/0173628 | A1* | 8/2005 | Ahern | H01J 49/105 250/288 |
| 2011/0316552 | A1* | 12/2011 | Shinada | G01N 27/70 324/464 |
| 2012/0326022 | A1* | 12/2012 | Kumano | H01J 49/0409 250/282 |
| 2013/0204244 | A1* | 8/2013 | Sakakita | A61B 18/042 606/40 |
| 2014/0062285 | A1* | 3/2014 | Chen | H05H 1/24 313/231.31 |
| 2015/0216027 | A1* | 7/2015 | Cheung | H05H 1/32 315/111.51 |
| 2016/0135277 | A1* | 5/2016 | Duimstra | H05H 1/30 356/316 |

* cited by examiner

*Primary Examiner* — Jason L McCormack
(74) *Attorney, Agent, or Firm* — Rhodes IP PLC; Christopher R Rhodes

(57) ABSTRACT

Devices, systems and methods using counterflow sample introduction are described. In certain examples, the devices, systems and methods may be configured to introduce a fluid flow comprising a sample into a torch comprising a plasma in a direction that opposes the flow of a gas used to sustain the plasma. Optical emission devices, optical absorption devices and mass spectrometers using the counterflow sample introduction are also described.

15 Claims, 12 Drawing Sheets

COUNTERFLOW SAMPLE INTRODUCTION AND DEVICES, SYSTEMS AND METHODS USING IT

PRIORITY APPLICATION

This application is related to, and claims priority to and the benefit of, U.S. Provisional Application No. 62/341,225 filed on May 25, 2016, the entire disclosure of which is hereby incorporated herein by reference for all purposes.

TECHNOLOGICAL FIELD

Certain examples disclosed herein relate to devices and methods for introducing a sample flow into a plasma in a substantially opposite direction to the direction of a gas flow used to sustain the plasma.

BACKGROUND

A plasma may be used to ionize and/or atomize a sample. The plasma is also used to desolvate the sample after it is introduced into the plasma. The desolvation can increase the background signal which can reduce the overall sensitivity of analytical devices that include a plasma. There remains a need for betters devices and methods to introduce samples into plasma devices.

SUMMARY

In a first aspect, a system comprising a torch configured to sustain a plasma, and a sample introduction device fluidically coupled to the torch and configured to provide a sample fluid flow to the torch in a direction that opposes a flow of a plasma gas used to sustain the plasma is provided.

In certain configurations, the sample introduction device comprises a nebulizer. In other configurations, the system comprises a detector configured to receive a signal from the torch. In some instances, the detector is configured to detect optical absorption or optical emission of ionized or atomized species in the torch or exiting the torch. In other examples, the system comprises a mass analyzer fluidically coupled to the torch. In some embodiments, the torch is configured to sustain a low flow plasma. In other examples, the system comprises an induction device comprising an aperture configured to receive the torch. In certain instances, the induction device comprises an induction coil. In other examples, the induction device comprises a plate electrode. In some embodiments, the induction device comprises an induction coil comprising a radial fin. In certain examples, the system comprises a radio frequency generator electrically coupled to the induction device. In some examples, the generator is configured to operate in a driven mode or in an oscillation mode. In further examples, the system is configured to operate in the driven mode, an oscillation more or switch between the two modes. In additional examples, the torch is configured to sustain the plasma using a total gas flow rate of less than 10 L/minute. In some embodiments, the torch comprises a port fluidically coupled to the sample introduction device, in which the port is non-parallel to a longitudinal axis of the torch. In other embodiments, the port is substantially perpendicular to the longitudinal axis of the torch. In certain instances, the torch is configured to sustain the plasma using only an auxiliary gas flow. In other examples, the system further comprises a mass spectrometer fluidically coupled to the torch. In some examples, the system comprises a controller coupled to the sample introduction device. In certain examples, the torch is configured to sustain a plasma in an auxiliary only mode.

In another aspect, a system comprising a sample introduction device, a torch configured to sustain a plasma and having a first end and a second end, the torch fluidically coupled to a plasma gas source at the first end and fluidically coupled to the sample introduction device at the second end, and a detector configured to detect species ionized and/or atomized by the plasma is described.

In some embodiments, the detector is selected from the group consisting of a mass analyzer, an optical emission detector and an optical absorption detector. In other embodiments, the torch is configured to sustain a low flow plasma. In further examples, the system comprises an induction device comprising an aperture configured to receive the torch. In other examples, the induction device comprises an induction coil. In some embodiments, the induction device comprises a plate electrode. In other embodiments, the induction device comprises an induction coil comprising a radial fin. In certain instances, the system comprises a controller coupled to the detector and the sample introduction device. In other examples, the sample introduction device is a nebulizer. In some instances, the torch is configured for operation in an auxiliary only mode.

In an additional aspect, a method of ionizing and/or atomized species in a sample comprising introducing a fluid flow comprising the sample into a torch comprising a plasma in a direction that opposes the flow of a plasma gas used to sustain the plasma is disclosed.

In certain examples, the method comprises fluidically coupling a sample introduction device to an end of the torch opposite to an end of the torch that receives the plasma gas. In other embodiments, the method comprises nebulizing the fluid flow prior to introduction into the torch. In some examples, the method comprises configuring the plasma as a low flow plasma. In some instances, the method comprises coupling the torch to a boost device. In further embodiments, the method comprises configuring the torch to sustain a plasma in an auxiliary only mode. In some embodiments, the method comprises sustaining the plasma using an induction device. In certain examples, the method comprises configuring the induction device to comprise an induction coil, a plate electrode, or an induction coil comprising a radial fin.

Additional aspects, embodiments, features and examples will be recognized by the person of ordinary skill in the art, given the benefit of this disclosure, and certain aspects and examples are described in more detail below.

BRIEF DESCRIPTION OF THE FIGURES

Certain examples are described below with reference to the accompanying figures in which.

It will be recognized by the person of ordinary skill in the art, given the benefit of this disclosure, that the exemplary torches, induction devices and other devices shown in the figures may not be to scale. Certain features or dimensions of the induction devices, the torches and the like may have been enlarged, reduced or distorted relative to other features to facilitate a better understanding of aspects and examples disclosed herein. The particular angle at which the sample is introduced into a torch is not intended to be limited by those shown in the figures. Instead, the fluid flows in the figures are shown merely for illustration and to facilitate a better understanding of the technology disclosed herein.

DETAILED DESCRIPTION

Certain examples described below are directed to devices, methods and systems that can provide, for example, a sample flow in a direction substantially opposite to the direction of bulk gas flow in a plasma device. By introducing the sample in a flow substantially opposite to that of the bulk plasma gas flow, the sample may be dried more efficiently before ionization of the species in the sample by the plasma. Such efficient drying has numerous attributes including, but not limited to, reduction of background signal and overall improvement in detection limits. These and other attributes of using a counter sample flow in the devices, methods and systems disclosed herein will be recognized by the person of ordinary skill in the art, given the benefit of this disclosure. A device where the sample is introduced in a flow that substantially opposes that of the plasma gas flow is referred to in certain instances below for convenience purposes as a counter-flow sample plasma (CFSP) device. CFSP devices are intended to include, but are not limited to, those implementing an inductively coupled plasma, a capacitively coupled plasma, an inductively-capacitively coupled plasmas, a low flow plasma and other types of plasmas that may be sustained within a torch.

Certain devices and components described herein may be fluidically coupled to each other. Such fluidic coupling may be accomplished by providing a flow path between the two components such that fluid, e.g., a liquid or gas, from one component may flow to the other component. In some examples, fluidic coupling may be provided by physically connecting the two components with a tube, port or fitting, whereas in other examples, the components may be positioned or arranged such that fluid can flow from one component to the other without any direct physical connection between them.

Figure 1A:
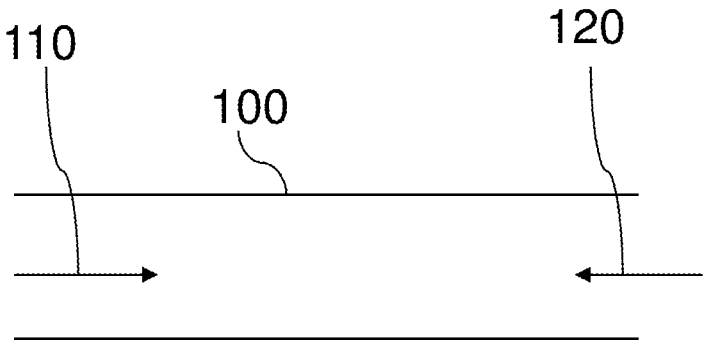
FIGS. 1A and 1B are schematics of a plasma gas flow and a sample fluid flow, in accordance with certain examples.

In certain embodiments, the devices, methods and systems disclosed herein may include a torch configured with suitable ports to provide a plasma within the torch and to permit introduction of sample from a suitable device in a fluid flow direction that is substantially opposite to the direction of the plasma gas flow. The direction of flow for two fluids is shown schematically in FIG. 1A. The plasma gas flow 110 flows in a direction that is substantially parallel to a longitudinal axis of an outer body of a torch 100. The plasma gas flow 110 may be used to sustain a plasma, such as, for example, an inductively coupled plasma, a capacitively coupled plasma, an inductively-capacitively coupled plasma, a low flow plasma or the like, within the torch 100. A sample flow 120 may be introduced such that the direction of the sample flow 120 opposes the direction of the plasma gas flow 110 for at least some period during operation of the torch 100. For example, the sample flow 120 may be introduced at an end of the torch 100 that is opposite to the end of the torch 100 where the plasma gas flow 110 is introduced. In other embodiments, the sample flow 120 may be introduced at a side of the torch and in a direction that opposes the flow of the bulk plasma gas.

Figure 1B:
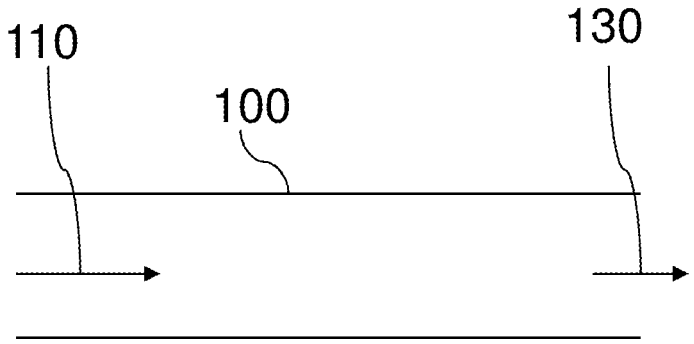

Depending on the exact flow rates of the plasma gas flow 110 and the sample flow 120, the time that the sample flow 120 opposes that of the plasma gas flow 110 may vary. At some point after introduction of the sample into the torch 100, the sample flow 120 reverses its direction to become sample flow 130 (as shown in FIG. 1B) and may exit the torch 100, for example, at the same end it enters the torch 100. By introducing the sample in a flow that opposes the plasma gas flow 110, improved drying of the sample and reduction in the overall background of the plasma may be achieved. Also, by selecting the flow rates of the plasma gas and the sample, the depth at which the sample enters the plasma may be selected or controlled. For example, the fluid flows may be selected so that the sample enters the hottest part of the plasma, is ionized, and then flows out of the plasma to a detector or other suitable device.

In certain examples, the plasma gas may be provided at a flow rate of about 8 L/minute to about 15 L/minute. In some examples, the sample fluid flow may be provided at a flow rate of about 5 L/minute to about 20 L/minute. It may be desirable to match the flow rates of the plasma gas flow and the sample flow such that the depth at which the sample enters into the plasma is selected or controlled. For example, by selecting the fluid flow rates to be substantially the same, the sample fluid flow can enter the plasma but does not exit the end of the plasma where the bulk plasma gas is introduced. Instead, subsequent to introduction of the sample, the sample enters the plasma, is ionized and/or atomized and then becomes entrained in the plasma gas flow and exits the end of the torch.

In other examples, the sample flow rate may be substantially less than the flow rate of the plasma gas, depending on the distance the sample is introduced from the plasma. For example, the sample introduction device may be positioned at various portions along the torch body, and depending, at least in part, on the distance the sample is introduced from the plasma, the flow rate of the sample may be less than that of the plasma gas. In some examples, the plasma gas may be provided at a flow rate of about 5-15 L/minute and the sample may be provided at a flow rate of about 0.5-1.5

L/minute. In embodiments where an auxiliary gas is used, the auxiliary gas may be provided at a flow rate of about 5-15 L/minute. In some examples described herein, the plasma is operated as an auxiliary only plasma (AUX) plasma or in an auxiliary only mode and the plasma gas is omitted. In such instances, the auxiliary gas may be introduced at a flow rate of about 5-15 L/minute and the sample may be introduced at a flow rate of about 0.5-1.5 L/minute. In embodiments where the plasma gas is omitted, the auxiliary gas is the gas used to sustain the plasma.

In certain embodiments, each of the plasma gas and the sample flow may be provided at a substantially constant flow rate. For example, the flow rate of the plasma gas and the sample may be substantially constant during the period at which the fluid flows are provided to the torch. While the plasma gas may be provided substantially all the time during operation of the torch, the sample is typically provided by introducing a desired volume of sample fluid into the torch and waiting for a period until additional sample in introduced into the torch. When the sample is being introduced, it may be provided in a generally continuous form or may be introduced in pulses into the plasma. In some examples, during introduction of the sample fluid, the plasma gas flow may be pulsed or altered such that the sample can enter into the plasma with less opposing fluid flow.

Figure 2:
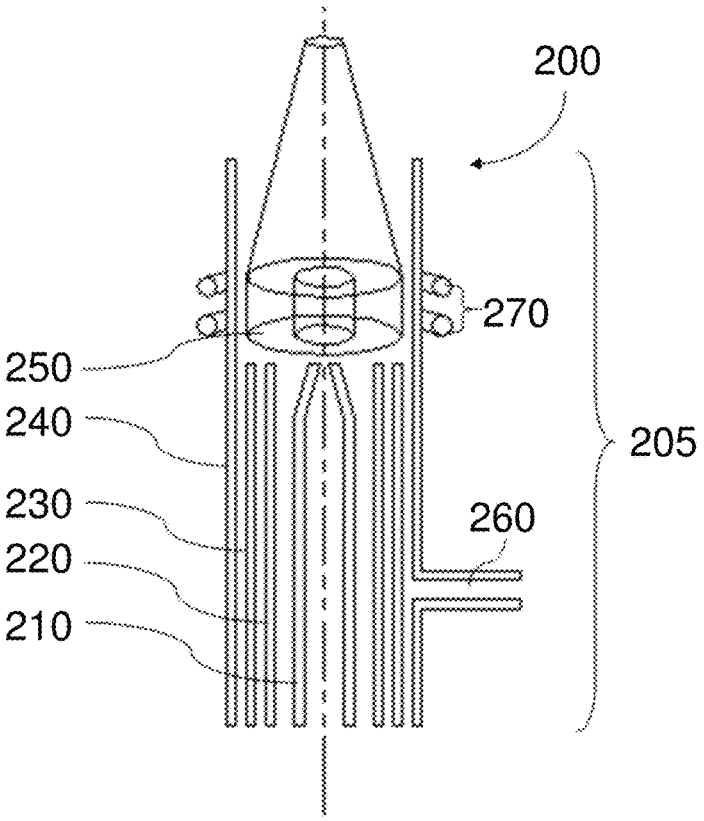
FIG. 2 is a schematic of a torch, in accordance with certain examples.

In some examples, the sample flow may be introduced into an opposing plasma gas flow through a torch as shown in FIG. 2. The torch may include a series of concentric tubes each of which may introduce a plasma gas, auxiliary gas, cooling gas or the like. Referring to FIG. 2, an inductively coupled plasma device 200 includes a chamber 205 comprising three or more tubes, such as tubes 210, 220, 230, 240, a plasma 250, an inlet 260 and radio frequency induction coils 270. The tube 210 is in fluid communication with a gas source, such as argon. As discussed herein, the sample introduction device may be coupled to the torch at a site (not shown) distal to that of the gas source. A gas such as argon can aerosolize the sample and carry it into the desolvation and ionization regions of the plasma 250. An auxiliary gas flow may be provided between tubes 210 and 220, and may be used to shift the plasma above the inner tubes to keep the tubes from melting. A plasma gas may be provided between tubes 220 and 230. A barrier gas passes between the outer tube 240 and the inner tube 230 to isolate the plasma 250 from the outer tube 240. Without wishing to be bound by any particular scientific theory or this example, a barrier gas may be introduced through inlet 260, and the barrier gas flow cools the inside wall of the outside tube 240 and centers the plasma 250 radially. The radio frequency inductions coils 270 are in electrical communication with a radio frequency generator (not shown) and are constructed and arranged to create the plasma 250 after the gas is ionized using an arc, spark, etc. The person of ordinary skill in the art, given the benefit of this disclosure, will be able to select or design suitable plasmas including, but not limited to inductively coupled plasmas, inductively-capacitively coupled plasmas, direct current plasmas, microwave induced plasmas, etc., and suitable devices for generating plasmas are commercially available from numerous manufacturers including, but not limited to, PerkinElmer Health Sciences, Inc. (Waltham, Mass.), Varian Instruments, Inc. (Palo Alto, Calif.), Teledyne Leeman Labs, (Hudson, N.H.), and Spectro Analytical Instruments (Kleve, Germany).

In some examples, the torch body shown in FIG. 2 may be modified such that one or more of the inner concentric tubes are absent. In such configurations, the auxiliary gas in the torch of FIG. 2, for example, may be the gas that sustains the plasma and the "plasma gas" and/or barrier gas in the torch of FIG. 2 may be absent. In such instances, a cooling gas may be provided to the outer surfaces of the torch to prevent melting of the torch body. For example, the torch may comprise a tube, and a gas for sustaining a plasma may be introduced through the tube. A cooling gas may be provided to the outer surfaces of the tube to prevent melting of the tube. A sample introduction device may be coupled to the torch at port, for example, such that, the sample flow opposes the plasma gas flow for at least some period during operation of the torch. Suitable torches can be produced by modifying existing torches. For example, the torch body may include fewer concentric tubes than those shown in the torch of FIG. 2. Such torches may be produced, for example, by disassembling a conventional torch removing one or more of the concentric tubes and reassembling the remaining portions of the torch. Alternatively, the torch may be produced with a desired number of tubes without having to modify an existing torch. Illustrative materials used in torches for plasmas include, but are not limited to, glass, quartz, $SiO_2$, $Al_2O_3$, various ceramics and other materials that can withstand the high plasma temperatures.

Figure 3A:
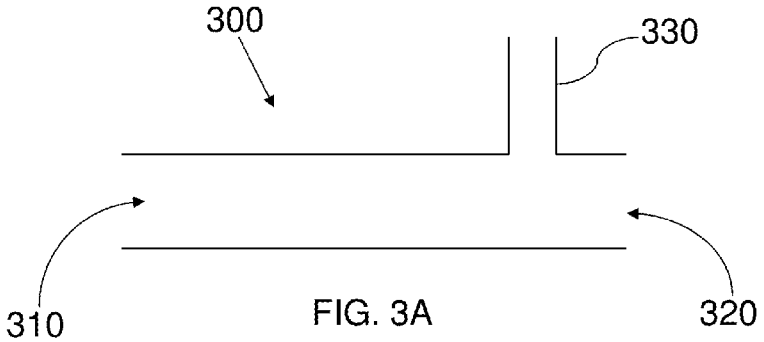
FIGS. 3A-3C are various representations showing introduction of a sample fluid flow in a direction counter to that of a plasma gas flow, in accordance with certain examples.
Figure 3B:
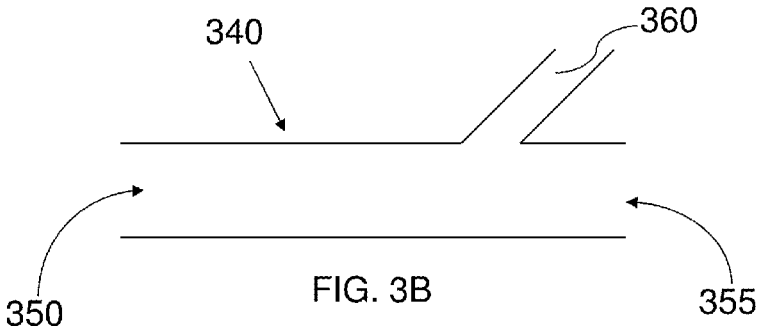
Figure 3C:
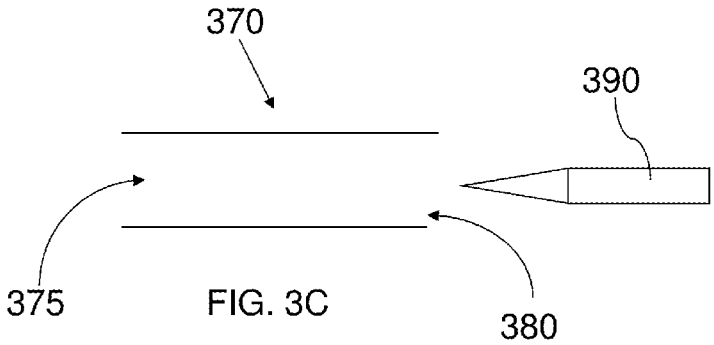

In certain configurations, the sample introduction device may be coupled to the torch through a port on the torch or may be introduced through an opening at the end of the torch. When coupled to the torch through a port on the torch, the port may be positioned at a selected angle with respect to the long axis of the torch body. Several examples of this configuration are shown in FIGS. 3A-3C. Referring to FIG. 3A, the torch 300 may include a first end 310 where plasma gas is introduced and a second end 320 where sample may exit after being ionized/atomized. The torch also includes a sample introduction port 330 positioned toward the second end 320 of the torch. In the embodiment shown in FIG. 3A, the sample introduction port 330 is positioned substantially perpendicular to the longitudinal axis of the torch 300. Sample may be introduced proximal to the end of the sample introduction port 330 and an assist gas (not shown) may be introduced into the torch 300 at the second end 320 in a direction that opposes the plasma gas flow to force or carry the introduced sample into the plasma. In examples where a nebulizer or injector is used, the assist gas may be omitted and the nebulizer or injector flow may be sufficient to introduce the sample into the torch. The sample introduction port 330 may be fluidically coupled to a sample introduction device (not shown) such as an aspirator or a nebulizer. While not shown in FIG. 3A, the plasma gas may enter the torch 300 from the first end 310 or may enter the torch 300 through one or more additional ports (not shown) of the torch 300. Such additional ports may be positioned perpendicular to the long axis of the torch body or may be positioned at other selected angles with respect to the long axis of the torch body. In some embodiments, such additional ports may be positioned toward the first end 310 such that they are upstream of any generated plasma within the torch 300.

In an additional configuration, the sample introduction port may be positioned at an angle such that the sample flows toward the plasma for at least some period during operation of the plasma. One embodiment is shown in FIG. 3B. The torch 340 includes a first end 350, a second end 355 and a sample introduction port 360 toward the second end 355 of the torch 340. The sample introduction port 360 is angled such that sample introduced through the port 360 may flow in an opposing direction to that of the plasma gas and into the plasma of the torch 340. The sample introduction port 360 may be fluidically coupled to a sample introduction device (not shown) such as an aspirator or a nebulizer. While not shown in FIG. 3B, the plasma gas may enter the torch 340 from the first end 350 or may enter the torch 340 through one or more additional ports (not shown) of the torch 340. Such additional ports may be positioned perpendicular to the long axis of the torch body or may be positioned at other selected angles with respect to the long axis of the torch body. In some embodiments, such additional ports may be positioned toward the first end 350 such that they are upstream of any generated plasma within the torch 340.

In another embodiment and referring to FIG. 3C, a sample may be introduced into a torch 370 at a second end 380 using a suitable sample introduction device 390 that is separate from the torch 370. The bulk plasma gas may enter the torch through the first end 375, while the sample is provided to the torch at the second end 380 at a suitable flow rate to introduce the sample into a plasma within the torch 370. The exact positioning of the sample introduction device 390 from the second end 380 of the torch 370 may vary. In some examples, the sample introduction device 390 is positioned such that a majority of the sample enters the torch 370 rather than flowing around the outside of the torch 370. While not shown in FIG. 3C, the second end 380 of the torch 370 may include a cone or funnel shape such that sample is directed into the torch 370 rather than around the torch 370. The sample introduction device 390 may be, for example, an aspirator, a nebulizer or other suitable sample introduction devices. The plasma gas may enter the torch 370 from the first end 375 or may enter the torch 370 through one or more additional ports (not shown) of the torch 370. Such additional ports may be positioned perpendicular to the longitudinal axis of the torch body or may be positioned at other selected angles with respect to the longitudinal axis of the torch body. In some embodiments, such additional ports may be positioned toward the first end 375 of the torch 370 such that they are upstream of any generated plasma within the torch 370. In some examples, the torch may include standoffs, projections or fittings to position the sample introduction device a desired distance from the torch.

Figure 4:
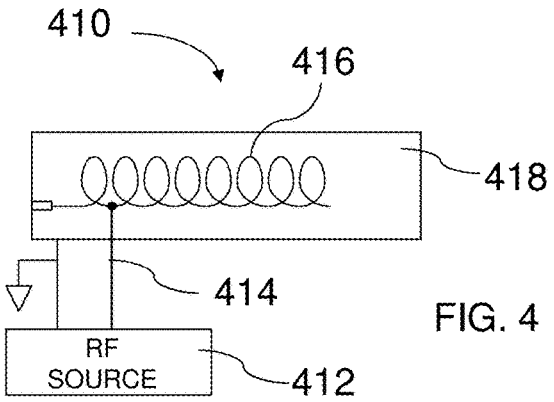
FIG. 4 is a device configured to sustain a plasma, in accordance with certain examples.

In accordance with certain examples, a plasma may be generated and sustained with a torch by providing suitable radio frequency energy to the torch. One illustrative device for providing radio frequency energy to a torch is shown in FIG. 4. The device is a helical resonator 410 that comprises a RF source 412, an electrical lead 414, which typically is a coaxial cable, configured to provide electrical coupling with a coil 416 in a resonant cavity 418. The resonant cavity 418 with the coil 416 may be configured to receive a chamber, such as, for example, the torches of FIGS. 1A, 1B, and 3A-3C. In certain examples, radio frequency energy of about 20 MHz to about 500 MHz can be generated using, for example, helical resonators. Exemplary dimensional information for construction of helical resonators will be readily selected by the person of ordinary skill in the art, given the benefit of this disclosure. In some examples, the coil 416 may have at least two full turns, for example, about four or more full turns.

In other examples, the plasma may be sustained using flat plate coils, such as those described, for example, in commonly assigned U.S. Pat. No. 7,106,438 entitled "ICP-OES and ICP-MS Induction Current," commonly assigned U.S. patent application Ser. No. 11/156,249 entitled "Boost Devices and Methods of Using Them" filed on Jun. 17, 2005, and commonly assigned U.S. patent application Ser. No. 11/218,912 entitled "Induction Device for Generating a Plasma" filed on Sep. 2, 2005.

In certain examples, the devices described herein may be used in an optical system configured for measurement of optical emission. In some instances, ionized and/or atomized species can emit light which may be detected using a suitable detector. The wavelength of light emission may be characteristic of the particular species in the sample. For example, many Group I, Group II, transition metals, actinides, lanthanides and other elements have ionized or atomized forms that emit light at very narrow wavelengths. Light emission may be monitored at a characteristic wavelength of a particular ion or atom to determine the presence and amount of such species within a sample.

Figure 5:
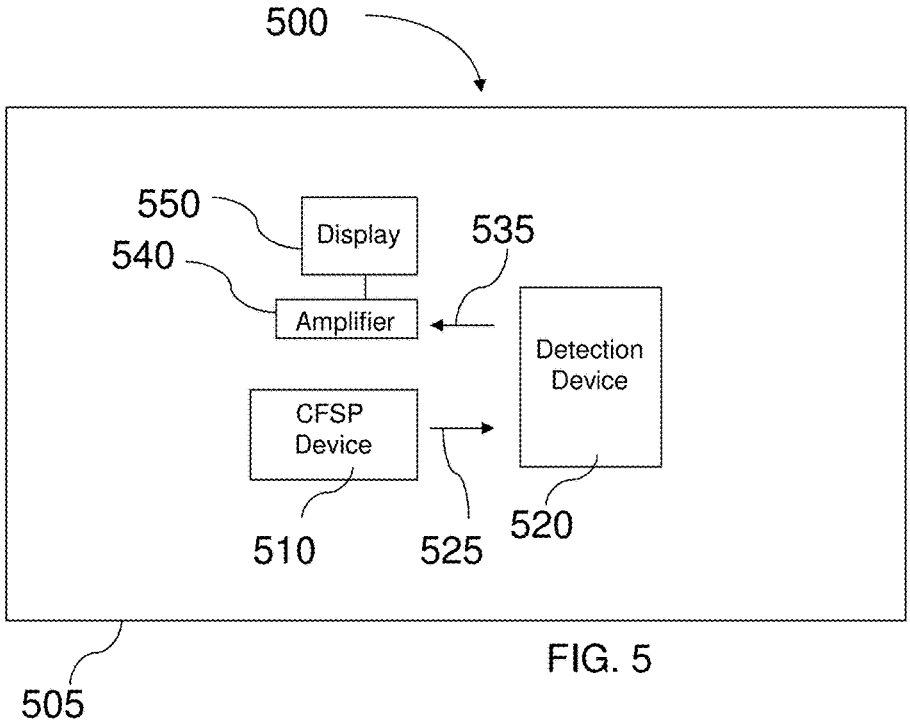
FIG. 5 is a schematic of an optical emission device that includes a counter-flow sample plasma (CFSP) device, in accordance with certain examples.

Referring to FIG. 5, an illustrative optical emission spectrometer (OES) is shown. OES device 500 includes a housing 505, a CFSP device 510 and a detection device 520. The CFSP device 510 may include a torch configured to sustain a plasma and a sample introduction device that can provide a sample to the plasma in the torch in a flow direction that substantially opposes the direction of plasma gas flow. The CFSP device 510 typically includes a nebulizer that is configured to aerosolize liquid sample for introduction into the plasma. In other examples, the sample introduction device of the CFSP device 510 may be an injector configured to receive aerosol sample that can be directly injected or introduced into the plasma. Other suitable devices and methods for introducing samples will be readily selected by the person of ordinary skill in the art, given the benefit of this disclosure. An optical emission 525 from, for example, an ionized or atomized species may be parallel to the detection device 520, and the selected light 535 may pass to an optional amplifier 540, which may be electrically coupled to a display 550. The detection device 520 can take numerous forms and may be any suitable device that can detect optical emissions, such as optical emission 525. For example, the detection device 520 may include suitable optics, such as a lens, a mirror, a prism, a window, a band-pass filter, etc. The detection device 520 may also include a grating, such as an echelle grating, to provide a multi-channel OES device. Gratings such as echelle gratings allow for simultaneous detection of multiple emission wavelengths. The gratings can be positioned within a monochromator or other suitable device for selection of one or more particular wavelengths to monitor. In other examples, the OES device may be configured to implement Fourier transforms to provide simultaneous detection of multiple emission wavelengths. The detection device can be configured to monitor emission wavelengths over a large wavelength range including, but not limited to, ultraviolet, visible, near and far infrared, etc. The detection device may include a solid-state detector, such as a charge coupled detector (CCD). The OES device 500 may further include suitable electronics such as a microprocessor and/or computer and suitable circuitry to provide a desired signal and/or for data acquisition. Suitable additional devices and circuitry are known in the art and may be found, for example, in commercially available OES devices such as an Optima 2100 DV series device, an Optima 5000 DV series device, or an Optima 2000 ICP OES device, which are commercially available from PerkinElmer Health Sciences, Inc. The optional amplifier 540 is operative to increase the signal, e.g., amplify the signal from detected photons, and may provide the signal to the display 550, which may be a printer, readout, computer, etc. In certain examples, the amplifier 540 may be, or may include, a photomultiplier tube configured to receive signals from the detection device 520. Other suitable devices for amplifying signals, however, will be selected by the person of ordinary skill in the art, given the benefit of this disclosure. In examples where the signal is large enough to be detected using the circuitry and devices in the detection device 520, the amplifier 540 may be omitted. It will be within the ability of the person of ordinary skill in the art, given the benefit of this disclosure, to retrofit existing OES devices to include CFSP devices and to design new OES devices using the CFSP devices disclosed herein. The OES devices may further include autosamplers, such as AS90 and AS93 autosamplers commercially available from PerkinElmer Health Sciences, Inc. or similar devices available from other suppliers.

Figure 6:
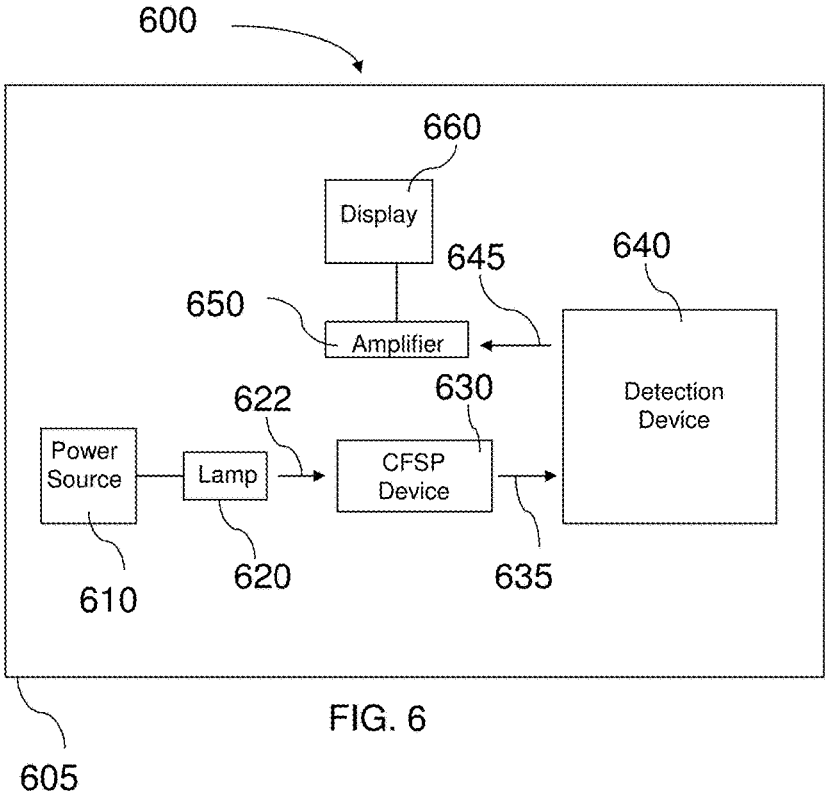
FIGS. 6 and 7 are schematics of an optical absorption devices that includes a CFSP device, in accordance with certain examples.

In some embodiments, the CFSP device may be used in optical absorption measurements. Atoms and ions can absorb certain wavelengths of light to provide energy for a transition from a lower energy level to a higher energy level. An atom or ion may contain multiple resonance lines resulting from transition from, for example, a ground state to higher energy levels. The energy needed to promote such transitions can be supplied using numerous sources, e.g., heat, flames, plasmas, arc, sparks, cathode ray lamps, lasers, etc. Suitable sources for providing such transition energy and suitable wavelengths of light for providing such transition energy will be readily selected by the person of ordinary skill in the art, given the benefit of this disclosure Referring to FIG. 6, an illustrative single beam device configured for optical absorption measurement is shown. The illustrative single beam AS device 600 includes a housing 605, a power source 610, a lamp 620 connected to the power source 610, a CFSP device 630, a detection device 640 configured to receive a signal from the CFSP device 630, an optional amplifier 650 configured to receive a signal from the detection device 640, and a display 660 in electrical communication with the amplifier 650. The power source 610 may be configured to supply power to the lamp 620, which provides one or more wavelengths of light 622 for absorption by atoms and ions. Suitable lamps include, but are not limited to electrode-less discharge lamps, hollow cathode lamps, mercury lamps, cathode ray lamps, lasers, etc., or combinations thereof. The lamp 620 may be pulsed using suitable choppers or pulsed power supplies, or in examples where a laser is implemented, the laser can be pulsed with a selected frequency, e.g., 5, 10, or 20 times per second. The exact configuration of the lamp 620 can vary. For example, the lamp 620 can provide light axially along the plasma of the CFSP device 630, for example, parallel to the long-axis of the torch, or can provide light radially along the plasma of the CFSP device 630, for example, perpendicular to the long-axis of the torch. The example shown in FIG. 6 is configured to provide light axially from the lamp 620. As discussed below, there can be signal-to-noise advantages using axial viewing of signals. As sample is atomized and/or ionized in the plasma of the CFSP device 630, the incident light 622 from the lamp 620 excites atoms. That is, some percentage of the light 622 that is supplied by the lamp 620 is absorbed by the atoms and ions in the plasma of the CFSP device 630. The remaining percentage of light 635 is transmitted to the detection device 640. The detection device 640 can select one or more suitable wavelengths using, for example, a prism, a lens, a grating and other suitable devices such as those discussed above in reference to the OES devices, for example. In some examples, the detection device 640 may include a solid-state detector, such as a CCD. The signal may be provided to the optional amplifier 650 for increasing the signal for transmission to the display 660. In examples where the signal is large enough to be detected using the circuitry and devices in the detection device 640, the amplifier 650 may be omitted. To account for the amount of absorption by sample and/or background in the CFSP device 630, a blank, such as water, can be introduced prior to sample introduction to provide a 100% transmittance reference value. The amount of light transmitted once sample is introduced into the CFSP device 630 may be measured, and the amount of light transmitted with sample can be divided by the reference value to obtain a transmittance. The negative $\log_{10}$ of the transmittance is equal to the absorbance. The AS device 600 may further include suitable electronics such as a microprocessor and/or computer and suitable circuitry to provide a desired signal and/or for data acquisition. Suitable additional devices and circuitry can be found, for example, on commercially available AS devices such as, for example, AAnalyst series spectrometers commercially available from PerkinElmer Health Sciences, Inc. It will be within the ability of the person of ordinary skill in the art, given the benefit of this disclosure, to retrofit existing AS devices to include the CFSP devices and to design new AS devices using the CFSP devices disclosed herein. The AS devices may further include autosamplers known in the art, such as AS-90A, AS-90plus and AS-93plus autosamplers commercially available from PerkinElmer Health Sciences, Inc.

Figure 7:
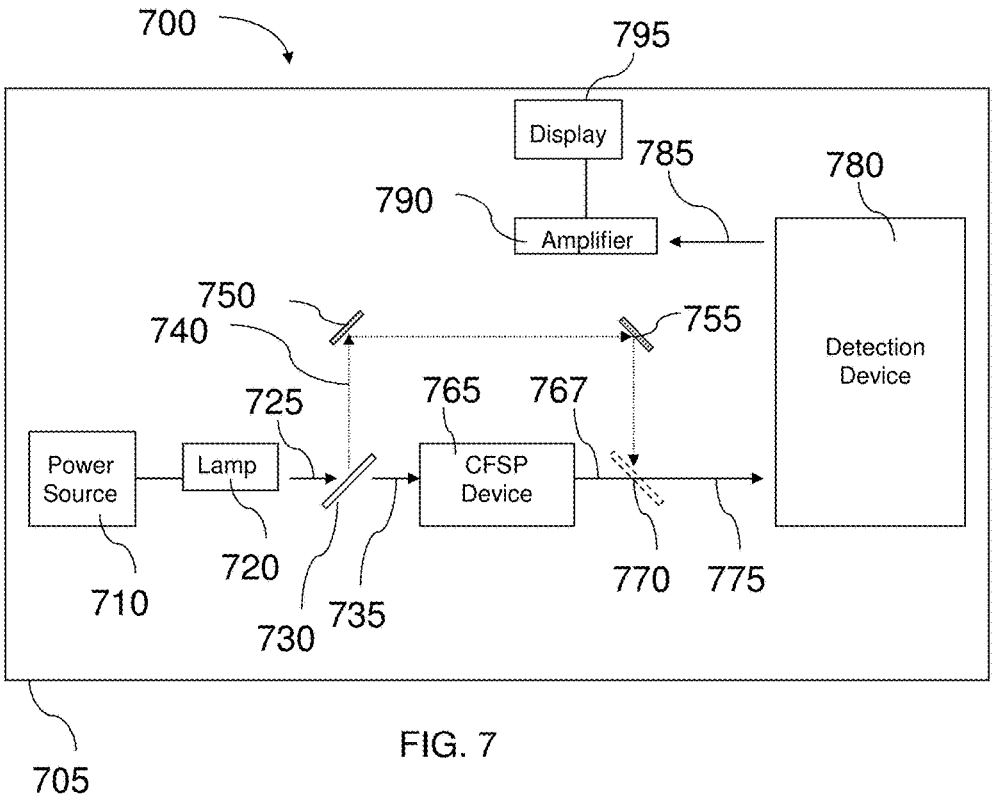

In accordance with certain examples and referring to FIG. 7, an illustrative dual beam AS device 700 includes a housing 705, a power source 710 in electrical communication with a lamp 720, a CFSP device 765, a detection device 780 configured to receive a light emission from the CFSP device 765, an optional amplifier 790 configured to receive a signal from the detection device 780 and an output device 795 configured to receive a signal from the amplifier 790. In examples where the signal is large enough to be detected using the circuitry and devices in the detection device 780, the amplifier 790 may be omitted. The power source 710 may be configured to supply power to the lamp 720, which provides one or more wavelengths of light 725 for absorption by atoms and ions. Suitable lamps include, but are not limited to, electrode-less discharge lamps, hollow cathode lamps, mercury lamps, cathode ray lamps, lasers, etc., or combinations thereof. The lamp may be pulsed using suitable choppers or pulsed power supplies, or in examples where a laser is implemented, the laser can be pulsed with a selected frequency, e.g. 5, 10 or 20 times per second. The configuration of the lamp 720 can vary. For example, lamp 720 can provide light axially along the plasma of the CFSP device 765 or can provide light radially along the plasma of the CFSP device 765. The illustration shown in FIG. 7 is configured for axial supply of light from the lamp 720. There can be signal-to-noise advantages using axial viewing of signals. As sample is atomized and/or ionized in the plasma of the CFSP device 765, the incident light 725 from the lamp 720 excites atoms. That is, some percentage of the light 735 that is provided by the lamp 720 may be absorbed by the atoms and ions in the CFSP device 765. At least a substantial portion of the remaining percentage of light 767 is transmitted to the detection device 780. In examples using dual beams, the incident light 725 can be split using a beam splitter 730 such that 50% of the light is transmitted as a beam 735 to the CFSP device 765 and 50% of the light is transmitted as a beam 740 to lenses 750 and 755. The light beams can be recombined using a combiner 770, such as a half-silvered mirror, and a combined signal 775 may be transmitted to the detection device 780. The ratio between a reference value and the value for the sample can then be determined to calculate the absorbance of the sample. The detection device 780 can select one or more suitable wavelengths using, for example, prisms, lenses, gratings and other suitable devices known in the art, such as those discussed above in reference to the OES devices, for example. In some examples, the detection device 780 may include a solid-state detector, such as a CCD. Signal 785 can be provided to the amplifier 790 for increasing the signal for output to the display 795. The AS device 700 may further include suitable electronics known in the art, such as a microprocessor and/or computer, and suitable circuitry to provide a desired signal and/or for data acquisition. Suitable additional devices and circuitry can be found, for example, on commercially available AS devices such as, for example, AAnalyst series spectrometers commercially available from PerkinElmer Health Sciences, Inc. It will be within the ability of the person of ordinary skill in the art, given the benefit of this disclosure, to retrofit existing dual beam AS devices to include the CFSP devices and to design new dual beam AS devices using the CFSP devices disclosed here. The AS devices may further include autosamplers known in the art, such as AS-90A, AS-90plus and AS-93plus autosamplers commercially available from PerkinElmer Health Sciences, Inc.

Figure 8A:
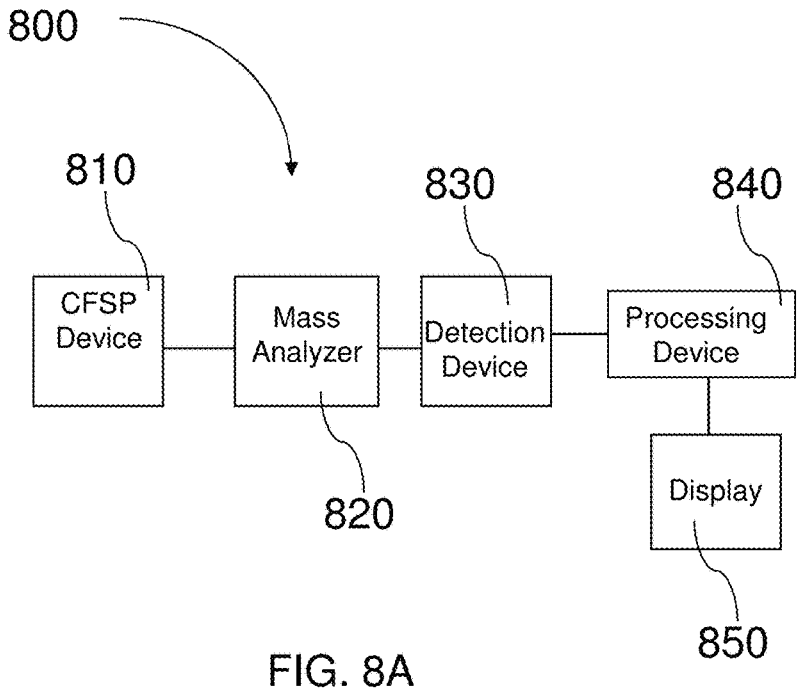
FIG. 8A is a schematic of a mass spectrometer that includes a CFSP device, in accordance with certain examples.

The CFSP devices disclosed herein may also be used in or with a mass spectrometer. In particular the mass spectrometer may include one or more CFSP devices. An illustrative MS device is shown in FIG. 8. An MS device 800 includes a CFSP device 810, a mass analyzer 820, a detection device 830, a processing device 840 and a display 850. The CFSP device 810, the mass analyzer 820 and the detection device 830 may be operated at reduced pressures using one or more vacuum pumps. In certain examples, however, only one or more of the mass analyzer 820 and/or the detection device 830 are operated at reduced pressures. The CFSP device 810 may include a suitable inlet or injector to provide sample to the mass analyzer 820. For example, one or more of a batch inlet, a direct probe inlet and/or chromatographic inlet may be used to provide ions and/or atoms from the CFSP device 810 to the mass analyzer 820. The CFSP device 810 may also include its own sample injector, nebulizer or other suitable devices to provide a sample to a plasma of the CFSP device 810. The mass analyzer 820 can take numerous forms depending generally on the sample nature, desired resolution, etc. and exemplary mass analyzers are discussed further below. The detection device 830 can be any suitable detection device that can be used with existing mass spectrometers, e.g., electron multipliers, Faraday cups, coated photographic plates, scintillation detectors, etc. and other suitable devices that will be selected by the person of ordinary skill in the art, given the benefit of this disclosure. The processing device 840 typically includes a microprocessor and/or computer and suitable software for analysis of samples introduced into the MS device 800. If desired, one or more databases can be accessed by the processing device 840 for determination of the chemical identity of species introduced into the MS device 800. Other suitable additional devices known in the art can also be used with the MS device 800 including, but not limited to, autosamplers, such as AS-90plus and AS-93plus autosamplers commercially available from PerkinElmer Health Sciences, Inc.

In certain embodiments, the mass analyzer of MS device 800 can take numerous forms depending on the desired resolution and the nature of the introduced sample. In certain examples, the mass analyzer is a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers (e.g., matrix-assisted laser desorbed ionization time of flight analyzers), and other suitable mass analyzers that can separate species with different mass-to-charge ratios. The CFSP devices disclosed herein can be used with any one or more of the mass analyzers listed above or other suitable mass analyzers.

In certain other examples, the CFSP devices disclosed herein may be used with existing ionization methods used in mass spectroscopy. For example, an electron impact source with a CFSP device can be assembled to increase ionization efficiency prior to entry of ions into the mass analyzer. In other examples, a chemical ionization source with a CFSP device may be assembled to increase ionization efficiency prior to entry of ions into the mass analyzer. In yet other examples, a field ionization source with a CFSP device may be assembled to increase ionization efficiency prior to entry of ions into the mass analyzer. In still other examples, a CFSP device may be used with desorption sources such as, for example, those sources configured for fast atom bombardment, field desorption, laser desorption, plasma desorption, thermal desorption, electrohydrodynamic ionization/desorption, etc. In yet other examples, a CFSP device may be configured for use with thermospray or electrospray ionization sources. It will be within the ability of the person of ordinary skill in the art, given the benefit of this disclosure, to design suitable devices for ionization including a CFSP device for use in mass spectroscopy.

In accordance with certain other examples, the OES, AS and MS devices disclosed here can be hyphenated with one or more other analytical techniques. For example, OES, AS or MS devices can be hyphenated with devices for performing liquid chromatography, gas chromatography, capillary electrophoresis, and other suitable separation techniques. When coupling an MS device that includes a CFSP device with a gas chromatograph, it may be desirable to include a suitable interface, e.g., traps, jet separators, etc., to introduce sample into the MS device from the gas chromatograph. When coupling an MS device to a liquid chromatograph, it may also be desirable to include a suitable interface to account for the differences in volume used in liquid chromatography and mass spectroscopy. For example, split interfaces can be used so that only a small amount of sample exiting the liquid chromatograph is introduced into the MS device. Sample exiting from the liquid chromatograph may also be deposited in suitable wires, cups or chambers for transport to the CFSP device of the MS device. In certain examples, the liquid chromatograph may include a thermospray configured to vaporize and aerosolize sample as it passes through a heated capillary tube. In some examples, the thermospray may include its own CFSP device, or other type of device including a plasma, to increase ionization of species using the thermospray. Other suitable devices for introducing liquid samples from a liquid chromatograph into a MS device, or other detection device, will be readily selected by the person of ordinary skill in the art, given the benefit of this disclosure.

In certain examples, an MS device that includes a CFSP device may be hyphenated to at least one other MS device, which may or may not include a CFSP device or other suitable device with a plasma, for tandem mass spectroscopy analyses. For example, one MS device can include a first type of mass analyzer and the second MS device can include a different or similar mass analyzer than the first MS device. In other examples, the first MS device may be operative to isolate the molecular ions, and the second MS device may be operative to fragment/detect the isolated molecular ions. It will be within the ability of the person of ordinary skill in the art, to design hyphenated MS/MS devices at least one of which includes a CFSP device.

Figure 8B:
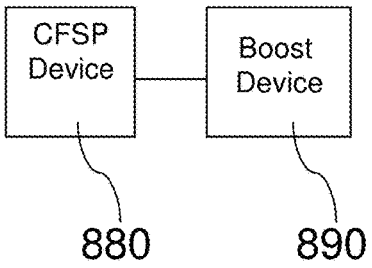
FIG. 8B is a schematic of a CFSP device fluidically coupled to a boost device, in accordance with certain examples.

In certain examples, the torch may be fluidically coupled to a boost device as shown in FIG. 8B. Illustrative boost devices are described, for example, in commonly assigned patent applications bearing U.S. application Ser. Nos. 11/156,249 and 11/156,274. The boost device 890 is fluidically coupled to a CFSP device 880 such that ionized and/or atomized species may flow into the boost device 890 from the CFSP device 880. In some examples, the boost device and the CFSP device share the same glassware, whereas in other examples, the boost device 890 may be positioned separate from the CFSP device 880 and optionally one or more interfaces may be used to provide sample from the CFSP device 880 to the boost device 990. In certain examples, the boost device 890 may take numerous forms, such as, for example, a coil of wire electrically coupled to a radio frequency generator and/or radio frequency transmitter. In other examples, boost devices may include one or more flat plates or coils in electrical communication with a RF generator. In some examples, the boost device may be constructed by placing a coil of wire in electrical communication with a radio frequency generator. The coil of wire may be wrapped around a chamber to supply radio frequency energy to the chamber. Suitable RF generators and transmitters will be readily selected by the person of ordinary skill in the art, given the benefit of this disclosure, and illustrative RF generators and transmitters include, but are not limited to, those commercially available from ENI, Trazar, Hunttinger and the like. In some examples, the boost devices may be in electrical communication with a primary RF generator, such as an RF source used to power a primary induction coil that generates and/or sustain a plasma. That is, in certain examples, the devices disclosed herein may include a single RF generator that is used to provide energy to a primary energy source, e.g., an atomization source such as a plasma, as well as one or more boost devices. Accordingly, in some embodiments, a boost device can be understood to be one or more secondary RF energy sources that, for example, may be coupled to a RF generator that may also be coupled to one or more primary RF energy sources.

In certain embodiments, the CFSP devices disclosed herein may be configured with a low flow plasma. Suitable low flow plasmas are described, for example, in commonly assigned U.S. patent application Ser. No. 11/372,996. The reduced flow rates of a low flow plasma may provide reduced turbulence and enhanced ionization and atomization of species in a sample introduced using a counterflow. In brief, the low flow plasma may be configured to operate at a total argon flow of less than ten or less than five liters per minute. The low flow plasma may be produced by generating a magnetic field in the torch and igniting the argon plasma gas in the magnetic field. After ignition of the plasma, the argon auxiliary gas flow rate may be increased, e.g., to about 16-20 L/minute. The argon plasma gas flow rate may be reduced to about 4-5 L/minute before being switched, e.g., pneumatically switched, to a nitrogen barrier gas of about the same 4-5 L/minute flow rate. Once this result is achieved, the auxiliary gas flow can be reduced to a minimum level needed to maintain a stable discharge while not overheating the glassware. This method may sustain a plasma using an auxiliary gas flow that is often used to control the height of the plasma above the injector. A nebulizer gas flow rate of about 0.5 to about 1 L/minute is typically used to introduce sample into the torch in an opposing flow, though the nebulizer gas flow rate may be reduced below 0.5 L/minute due to the reduced flow of the plasma and/or auxiliary gases in the low flow plasma. Non-argon barrier gases and auxiliary gases may also be used in a low flow plasma configured for use in a CFSP device.

In some examples, the detectors used with the CFSP devices may be configured for axial or radial viewing. When monitored or detected radially, signal from the torch (and/or the boost device if present) may be monitored in one or more planes parallel to the radius of the torch. For example, in an instrument configured to measure optical emissions radially, a detector may be positioned to detect signals that are emitted in a direction perpendicular to the long axis of the torch. When detected or monitored axially, signal from the chamber may be monitored or detected in one or more planes parallel to the long axis of the chamber. For example, in an instrument configured to measure optical emissions axially, a detector may be positioned to detect signals that are emitted in the direction that is parallel to the long axis of the torch. It will be recognized by the person of ordinary skill in the art, given the benefit of this disclosure, that axial and radial detection are not limited to optical emissions but may be used to detect signals from numerous other analytical techniques including absorption, fluorescence, phosphorescence, scattering, etc. In some examples, the background signal from axial detection may be reduced as compared to the background signal from radial detection. In addition, suitable devices may be used to block the background signal for both axial and radial detection.

In certain examples, the systems described herein may be controlled or used with, at least in part, a controller that may be part of a computer system or may be a stand-alone controller integrated into the device. Where the controller is part of a computer system, the computer systems may be, for example, a general-purpose computer such as those based on Unix, Intel PENTIUM-type processor, Motorola PowerPC, Sun UltraSPARC, Hewlett-Packard PA-RISC processors, or any other type of processor. It should be appreciated that one or more of any type computer system may be used according to various embodiments of the technology. Further, the system may be located on a single computer or may be distributed among a plurality of computers attached by a communications network. A general-purpose computer system according to one embodiment may be configured to perform any of the described functions including but not limited to: data acquisition, plasma gas flow rates, sample introduction flow rates, detection, boost device control and the like. It should be appreciated that the system may perform other functions, including network communication, and the technology is not limited to having any particular function or set of functions.

For example, various aspects may be implemented as specialized software executing in a general-purpose computer system. The computer system may include a processor connected to one or more memory devices, such as a disk drive, memory, or other device for storing data. The memory is typically used for storing programs and data during operation of the computer system. Components of computer system may be coupled by an interconnection mechanism, which may include one or more busses (e.g., between components that are integrated within a same machine) and/or a network (e.g., between components that reside on separate discrete machines). The interconnection mechanism enables communications (e.g., data, instructions) to be exchanged between system components. The computer system typically is electrically coupled to an interface on the system such that electrical signals may be provided from the system to the computer system for storage and/or processing.

Computer system may also include one or more input devices, for example, a keyboard, mouse, trackball, microphone, touch screen, and one or more output devices, for example, a printing device, status or other LEDs, display screen, speaker. In addition, computer system may contain one or more interfaces that connect computer system to a communication network (in addition or as an alternative to the interconnection mechanism). The storage system of the computer typically includes a computer readable and writeable nonvolatile recording medium in which signals are stored that define a program to be executed by the processor or information stored on or in the medium to be processed by the program. For example, the flow rates of the plasma gas and the sample fluid may be stored on the medium. The medium may, for example, be a disk or flash memory. Typically, in operation, the processor causes data to be read from the nonvolatile recording medium into another memory that allows for faster access to the information by the processor than does the medium. This memory is typically a volatile, random access memory such as a dynamic random access memory (DRAM) or static memory (SRAM). It may be located in storage system, as shown, or in memory system. The processor generally manipulates the data within the integrated circuit memory and then copies the data to the medium after processing is completed. A variety of mechanisms are known for managing data movement between the medium and the integrated circuit memory element, and the technology is not limited thereto. The technology is not limited to a particular memory system or storage system.

The computer system may also include specially-programmed, special-purpose hardware, for example, an application-specific integrated circuit (ASIC). Aspects of the technology may be implemented in software, hardware or firmware, or any combination thereof. Further, such methods, acts, systems, system elements and components thereof may be implemented as part of the computer system described above or as an independent component.

In some examples, the computer system may be a general-purpose computer system that is programmable using a high-level computer programming language. The computer system may be also implemented using specially programmed, special purpose hardware. In the computer system, the processor is typically a commercially available processor such as the well-known Pentium class processor available from the Intel Corporation. Many other processors are available. Such a processor usually executes an operating system which may be, for example, the Windows 95, Windows 98, Windows NT, Windows 2000 (Windows ME), Windows XP, Windows Vista, Windows 7, Windows 8 or Windows 10 operating systems available from the Microsoft Corporation, MAC OS System X operating system available from Apple Computer, the Solaris operating system available from Sun Microsystems, or UNIX or Linux operating systems available from various sources. Many other operating systems may be used. In addition or alternative to a processor, the computer system may include a controller such as for example and 8-bit or 16-bit controller. Other controllers such as 32-bit or higher controller may also be used in place of a processor or in addition to the processor of the computer system.

The processor and operating system together define a computer platform for which application programs in high-level programming languages can be written. It should be understood that the technology is not limited to a particular computer system platform, processor, operating system, or network. Also, it should be apparent to those skilled in the art that the present technology is not limited to a specific programming language or computer system. Further, it should be appreciated that other appropriate programming languages and other appropriate computer systems could also be used.

In certain examples, the hardware or software is configured to implement cognitive architecture, neural networks or other suitable implementations. For example, flow rates, RF frequencies, RF energies and the like may be stored in the system and used where a desired assay or measurement is to be performed. Such a configuration permits recall of known parameters for use in successive measurements, which can simplify the functionality and increase the overall ease of use by an end user.

One or more portions of the computer system may be distributed across one or more computer systems coupled to a communications network. These computer systems also may be general-purpose computer systems. For example, various aspects may be distributed among one or more computer systems configured to provide a service (e.g., servers) to one or more client computers, or to perform an overall task as part of a distributed system. For example, various aspects may be performed on a client-server or multi-tier system that includes components distributed among one or more server systems that perform various functions according to various embodiments. These components may be executable, intermediate (e.g., IL) or interpreted (e.g., Java) code which communicate over a communication network (e.g., the Internet) using a communication protocol (e.g., TCP/IP). It should also be appreciated that the technology is not limited to executing on any particular system or group of systems. Also, it should be appreciated that the technology is not limited to any particular distributed architecture, network, or communication protocol.

Various embodiments may be programmed using an object-oriented programming language, such as SmallTalk, Basic, Java, C++, Ada, or C# (C-Sharp). Other object-oriented programming languages may also be used. Alternatively, functional, scripting, and/or logical programming languages may be used. Various aspects may be implemented in a non-programmed environment (e.g., documents created in HTML, XML or other format that, when viewed in a window of a browser program, render aspects of a graphical-user interface (GUI) or perform other functions). Various aspects may be implemented as programmed or non-programmed elements, or any combination thereof.

In certain examples, a user interface may be provided such that a user may enter desired parameters such as, for example, sample volume, flow rates, detection wavelength, acquisition rates and times and the like. Other features for inclusion in a user interface will be readily selected by the person of ordinary skill in the art, given the benefit of this disclosure.

In certain embodiments, methods of using a sample fluid flow that is counter to that of the plasma gas are provided. In some examples, the method comprises introducing a fluid flow comprising the sample into a torch comprising a plasma in a direction that opposes the flow of a plasma gas used to sustain the plasma. As discussed herein, this counterflow may be provided by fluidically coupling a sample introduction device to a torch. In other examples, such sample introduction device may be fluidically coupled at an end of the torch opposite to an end of the torch that receives the plasma gas. In some examples, the sample introduction device may take the form of a nebulizer. As discussed herein, the plasma may be an inductively coupled plasma, a capacitively coupled plasma, an inductively-capacitively coupled plasmas, a low flow plasma or other suitable types of plasma. In certain embodiments, the torch may be coupled to one or more boost devices, which may share the glassware of the torch or may be separate from the glassware used for the torch. In some examples, the torch may be configured to sustain a plasma in an auxiliary only mode.

In some embodiments, the counter flow sample introduction can be used in common with a hybrid generator configured to operate in a driven more, an oscillation mode or that can switch between the two modes. One such hybrid generator is described in commonly assigned U.S. patent application Ser. No. 14/520,446 filed on Oct. 22, 2014, the entire disclosure of which is hereby incorporated herein by reference for all purposes. Similarly, different induction devices such as the "pine cone" induction coils and devices, e.g., those comprising one or more radial fins, described in commonly assigned U.S. patent application Ser. No. 14/603,480 filed on Jan. 23, 2015, the entire disclosure of which is hereby incorporated herein by reference for all purposes, can also be used.

Certain specific examples are described below to illustrate further some of the novel and non-obvious examples of the technology described herein.

Example 1—Modified Torch

Figure 9A:
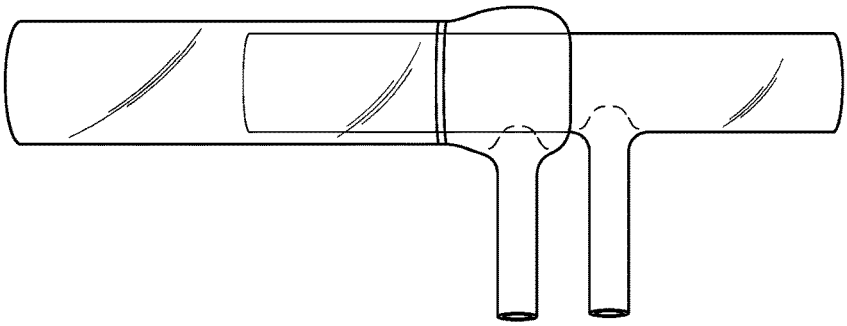
FIG. 9A-9C are black and white line drawings reproduced from photographs that sequentially show the disassembly of a torch and reassembly to provide a torch configured for operation in an auxiliary only mode, in accordance with certain examples.
Figure 9B:
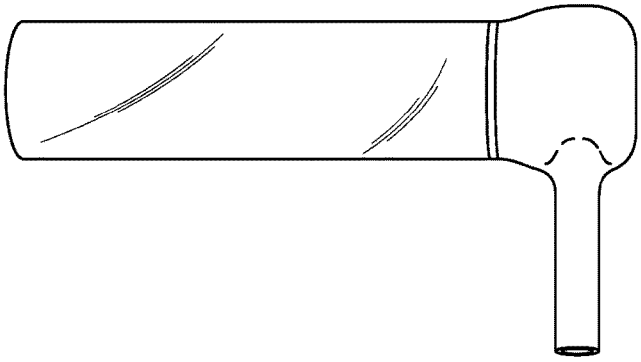
Figure 9C:
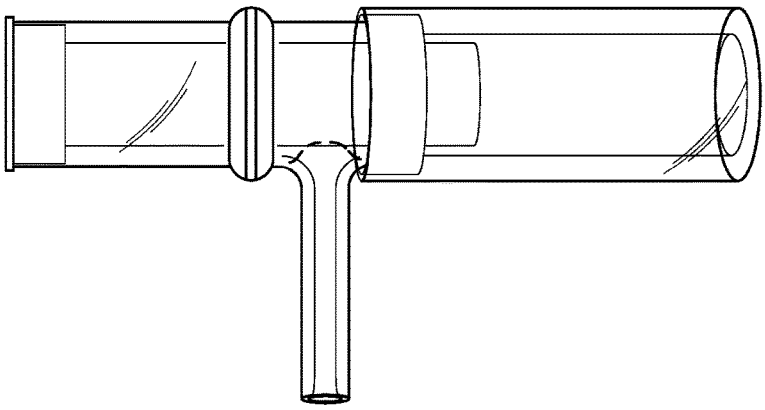
Figure 9D:
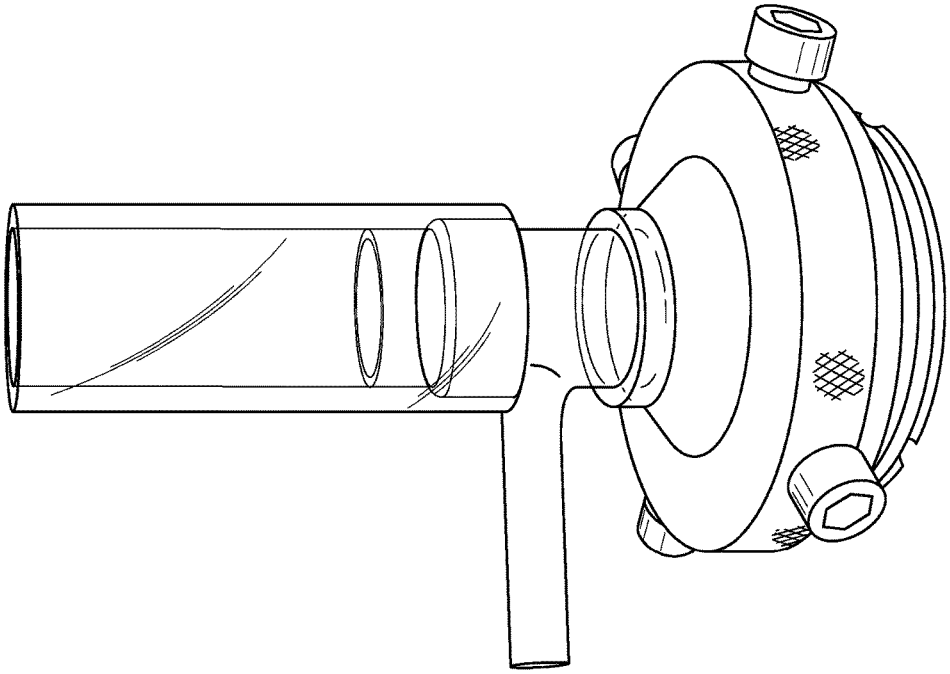
FIG. 9D is a black and white line drawing reproduced from a photograph of a torch and mount, in accordance with certain examples.

A standard torch as used in an Optima 3000XL device (from PerkinElmer Health Sciences, Inc.) was modified as follows: the torch was fabricated by cutting and salvaging parts from an Optima 3000XL torch (part number N069-5379). The torch pictured in FIG. 9A was cut, using a diamond wheel, just above the weld cutting the outer tube only. What used to be the Aux tube of the XL torch was shortened by 17 mm and a quartz window was taped to the bottom with Teflon pipe tape and became the bottom of the new torch. What used to be the bottom of the XL torch was shortened by 20 mm and becomes the Aux tube of the new torch. A 57 mm section of clear tube was cut out of the remaining outer tube (FIG. 9B) which became the outer tube of the new torch. A thick layer of Teflon tape was built up just below the gas inlet for a snug fit against the inside diameter of the outer tube. The torch mount was made by removing the window and O-ring of the snout, drilling, tapping, and adding four adjustment screws and enlarging the entrance aperture to form a torch mount. The completed torch is shown in FIG. 9C. The assembled torch and mount is shown in FIG. 9D. In operation, the device was run in an Aux only mode as there was only one gas inlet in the modified torch.

Example 2—CFSP Device

Figure 10:
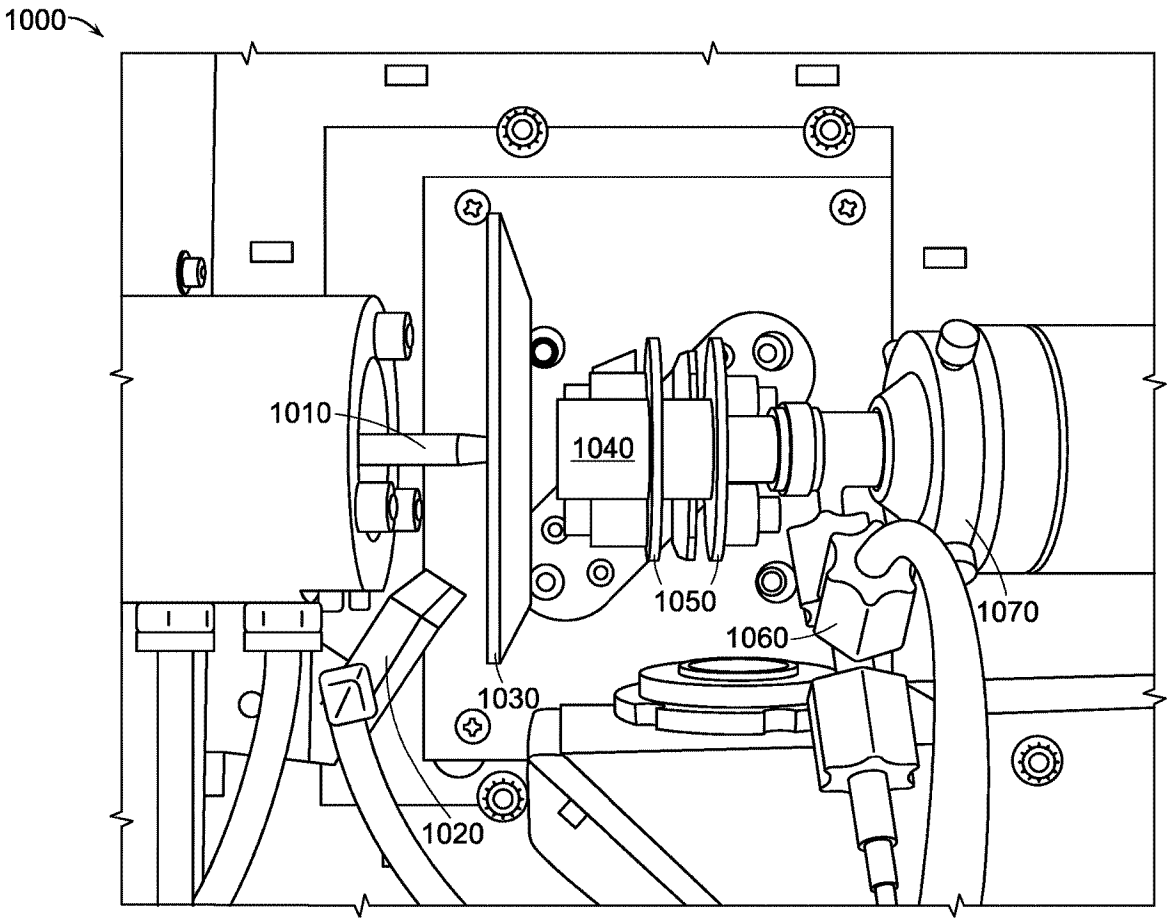
FIG. 10 is a black and white line drawing reproduced from a photograph showing the components of an optical emission device that includes a CFSP device, in accordance with certain examples.

A standard Optima 2000 ICP OES (from PerkinElmer Health Sciences, Inc.) was modified as shown in the black and white line drawing reproduced from a photograph in FIG. 10. The CFSP device 1000 included a sample injector 1010, a shear gas nozzle 1020, an aluminum plate 1030, a torch 1040, flat induction plates 1050, ignition wire and auxiliary gas 1060 and a modified snout 1070. The glassware was removed from the standard torch, the small bore (1.2 mm) injector 1010 was shortened in length by 10 mm, and sample introduction was left intact. A 69 mm by 76 mm by 3 mm thick aluminum plate 1030 had a 4.9 mm hole drilled in the center and placed over the end of the injector. The shear gas nozzle 1020 was relocated to the end of the torch mount and air flow was directed against the aluminum plate 1030 to prevent it from melting. The oscillator was shifted 14 mm from center to the right. The ignition wire was disconnected from the torch mount and connected to the igniter assembly (part number N069-0607). The plasma gas line was disconnected from the bulk-head fitting inside of the torch box and connected to this igniter assembly. Two flat induction plates 1030 (PerkinElmer part number N0781044) were used. The CFSP device 1000 included the modified torch of Example 1.

Example 3

Background measurements were performed using a standard configuration Optima 2000 ICP OES and using the setup described in Example 2. The sample conditions were as follows for each of the measurements: 1500 Watt plasma, 10 L/min Aux flow, no plasma gas flow, 0.8 L/min Nebulizer flow. The results are shown in Table I below. Each of the wavelengths tested and a corresponding element that emits light at that wavelength is listed in the table. The Normal Blank Int column refers to the background signal using the Optima 2000 device.

TABLE I

| | CFP (aux only) Blank Int | Normal Blank Int | Improvement factor |
|---|---|---|---|
| As 188.979 | 2111 | 6133 | 2.9 |
| Tl 190.801 | 2464 | 6144 | 2.5 |
| As 193.696 | 3310 | 8282 | 2.5 |
| Se 196.026 | 2398 | 5907 | 2.5 |
| Cd 214.440 | 7794 | 21889 | 2.8 |
| Pb 220.353 | 9192 | 27056 | 2.9 |
| Cd 226.502 | 13260 | 38784 | 2.9 |
| Zn 206.200 | 4737 | 12473 | 2.6 |
| Cu 224.700 | 13424 | 37369 | 2.8 |
| Mn 257.610 | 26399 | 81856 | 3.1 |
| Mg 280.271 | 29918 | 92168 | 3.1 |
| Mg 285.213 | 17998 | 53734 | 3.0 |
| Cu 324.752 | 53975 | 172803 | 3.2 |

As shown in Table I, the background signal was at least two times lower at all wavelengths tested when the CFSP device was used as compared to the standard Optima 2000 device.

Example 4—Detection Limits

Detection Limits (in micrograms/mL) for various elements were also determined using the CFSP device (listed as CFN in Table II) and the Optima 2000 (listed as Normal plasma in Table II). The results are shown in Table II below. The sample conditions were as follows: 1500 watt plasma, 10 L/min Aux flow, no plasma flow, 0.8 L/min nebulizer flow Three separate measurements are listed in Table II below.

TABLE II

| | Normal Plasma | CFN | Normal Plasma | CFN | Normal Plasma |
|---|---|---|---|---|---|
| As 188.979 | 5.7 | 3.0 | 1.1 | 1.1 | 7.1 |
| Tl 190.801 | 622 | 3.2 | 1.1 | 0.7 | 1.2 |
| As 193.696 | 10.1 | 4.4 | 1.5 | 1.8 | 1.4 |
| Se 196.026 | 14.0 | 4.4 | 0.5 | 2.1 | 3.5 |
| Zn 206.200 | 0.18 | 0.20 | 0.09 | 0.09 | 0.28 |
| Cd 214.440 | 0.30 | 0.15 | 0.14 | 0.06 | 0.61 |
| Pb 220.353 | 1.7 | 0.49 | 1.47 | 0.35 | 0.90 |
| Cu 224.700 | 1.2 | 0.21 | 0.243 | 0.108 | 0.378 |
| Cd 226.502 | 0.154 | 0.069 | 0.11 | 0.09 | 0.28 |
| Mn 257.610 | 0.096 | 0.0070 | 0.0091 | 0.0033 | 0.0393 |
| Mg 280.271 | 0.012 | 0.0036 | 0.0045 | 0.0012 | 0.0051 |

TABLE II-continued

| | Normal Plasma | CFN | Normal Plasma | CFN | Normal Plasma |
|---|---|---|---|---|---|
| Mg 285.213 | 0.048 | 0.034 | 0.055 | 0.013 | 0.036 |
| Cu 324.752 | 0.081 | 0.033 | 0.036 | 0.011 | 0.061 |

Background equivalent concentrations (BECs) were also determined for each of the elements tested. These results are shown in Table III below.

TABLE III

| | Normal Plasma | CFN | Normal Plasma | CFN | Normal Plasma |
|---|---|---|---|---|---|
| As 188.979 | 0.237 | 0.161 | 0.270 | 0.157 | 0.332 |
| Tl 190.801 | 4.369 | 0.224 | 0.288 | 0.052 | 0.292 |
| As 193.696 | 0.319 | 0.214 | 0.380 | 0.220 | 0.441 |
| Se 196.026 | 0.780 | 0.232 | 0.377 | 0.276 | 0.424 |
| Zn 206.200 | 0.026 | 0.014 | 0.041 | 0.019 | 0.051 |
| Cd 214.440 | 0.019 | 0.012 | 0.037 | 0.012 | 0.049 |
| Pb 220.353 | 0.354 | 0.149 | 0.516 | 0.090 | 0.359 |
| Cu 224.700 | 0.134 | 0.054 | 0.141 | 0.036 | 0.151 |
| Cd 226.502 | 0.024 | 0.014 | 0.044 | 0.014 | 0.018 |
| Mn 257.610 | 0.011 | 0.003 | 0.008 | 0.002 | 0.010 |
| Mg 280.271 | 0.004 | 0.001 | 0.004 | 0.001 | 0.005 |
| Mg 285.213 | 0.042 | 0.007 | 0.025 | 0.003 | 0.024 |
| Cu 324.752 | 0.112 | 0.013 | 0.043 | 0.009 | 0.036 |

The average improvement in detection limit and the average BEC using the CFSP device are listed in Table IV.

TABLE IV

| | Average DL improvement | Average BEC Improvement |
|---|---|---|
| As 188.979 | 1.4 | 1.6 |
| Tl 190.801 | 1.6 | 5.6 |
| As 193.696 | 1.6 | 1.6 |
| Se 196.026 | 1.7 | 2.4 |
| Zn 206.200 | 0.9 | 2.4 |
| Cd 214.440 | 2.2 | 3.7 |
| Pb 220.353 | 3.8 | 2.7 |
| Cu 224.700 | 3.9 | 2.3 |
| Cd 226.502 | 1.7 | 2.8 |
| Mn 257.610 | 8.2 | 4.5 |
| Mg 280.271 | 3.5 | 4.2 |
| Mg 285.213 | 2.8 | 6.6 |
| Cu 324.752 | 2.9 | 6.8 |

As shown in Tables II-IV, the detection limit with all elements either improved or is about the same using the CFSP device as compared to a standard Optima 2000 device. In addition, the BEC's using the CFSP device were substantially lower than those using the Optima 2000.

Example 5—Plasma Temperatures

Figure 11A:
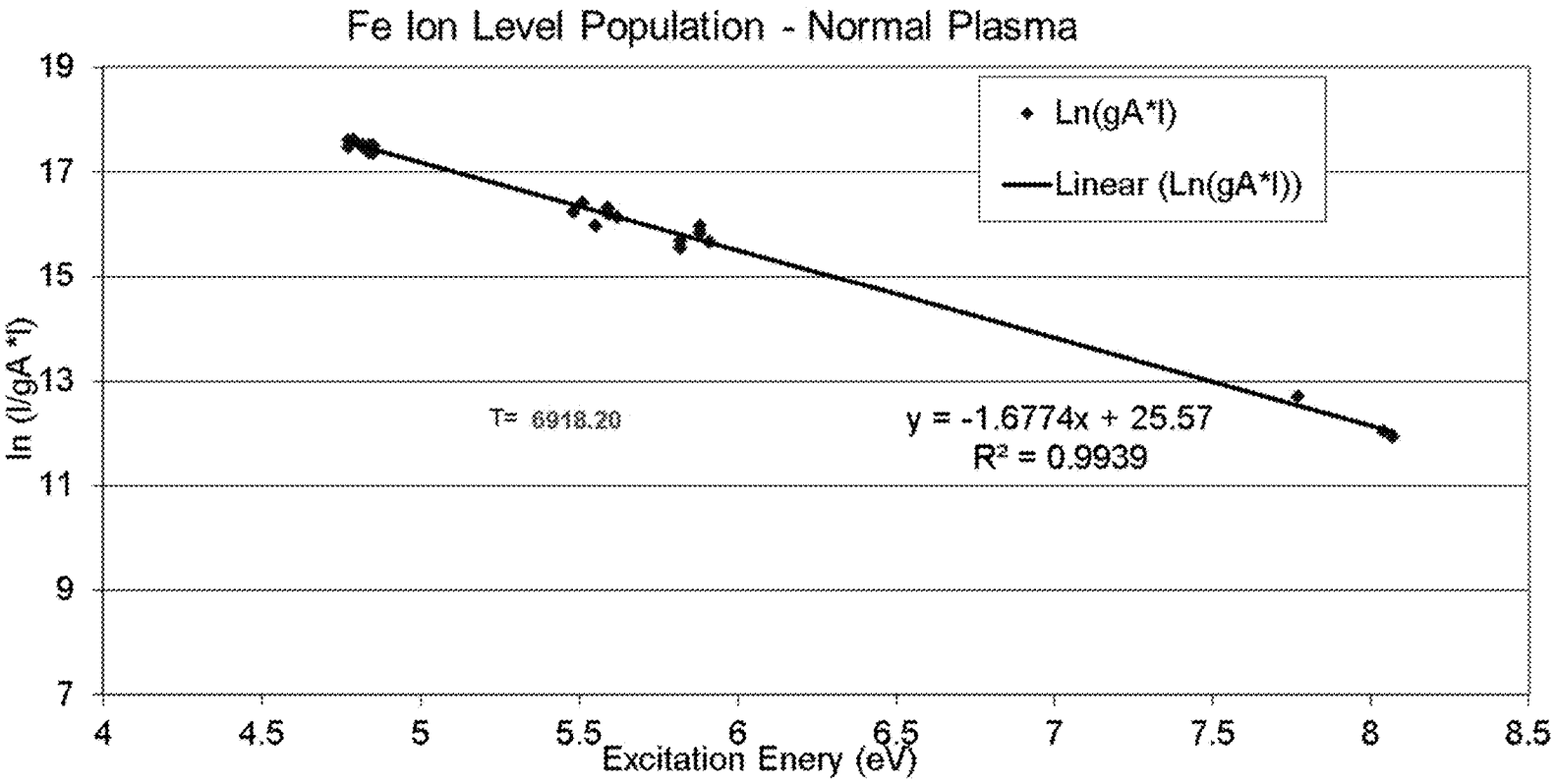
FIGS. 11A and 11B are Saha-Boltzmann plots for determining the temperature of a plasma of a normal plasma and a CFSP device.
Figure 11B:
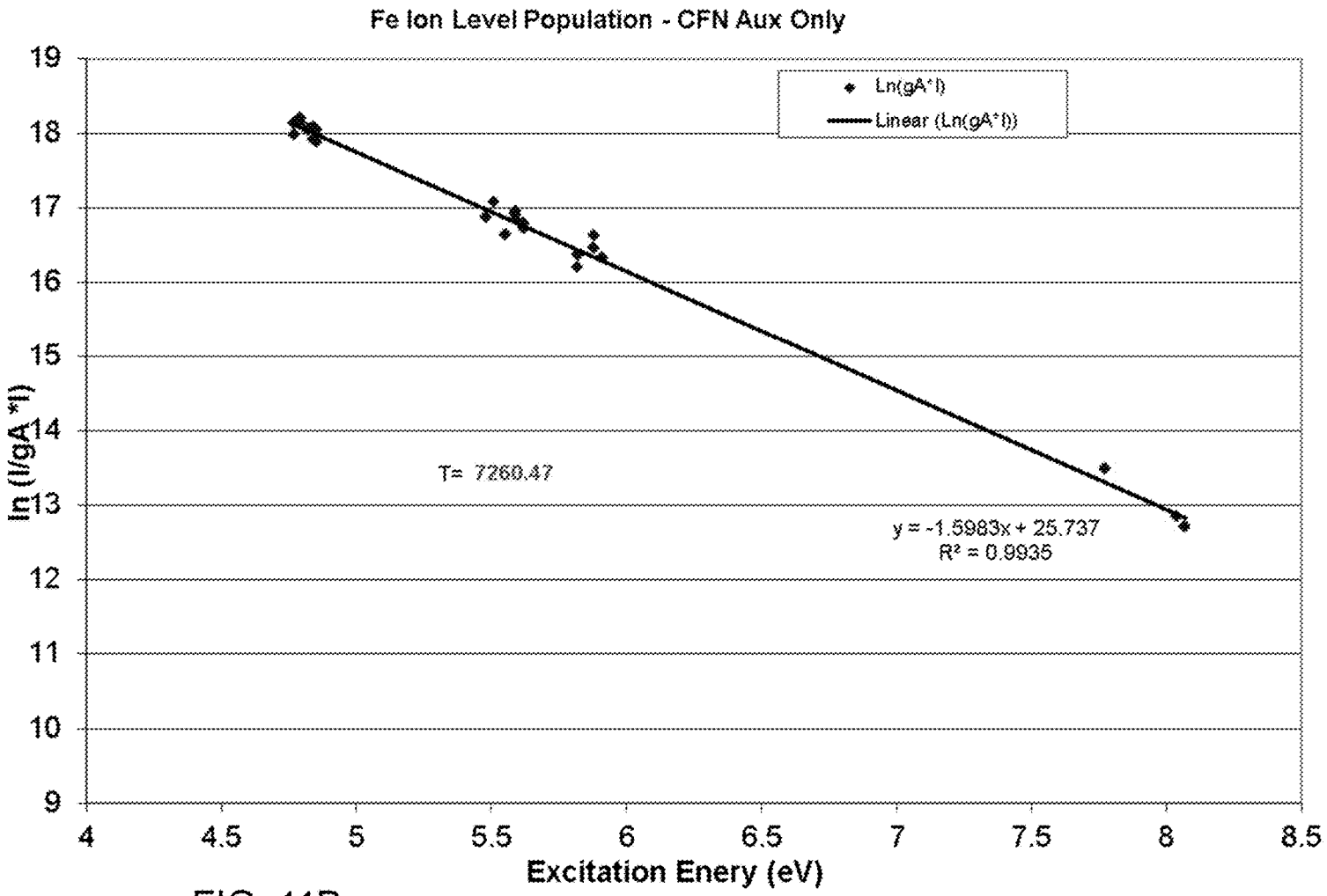

Plasma temperatures were calculated for a conventional plasma and a plasma of a CFSP device using several iron lines. To calculate the plasma temperature a Saha-Boltzmann plot was generated by plotting the natural log of (wavelength/(g×A)) versus excitation energy. g is the degeneracy and A is the transition probability. The slope of the resulting curve is −1/kT with k being Boltzmann's constant and T being the temperature of the plasma. FIG. 11A shows the resulting plot for the normal plasma, and FIG. 11B shows the resulting plot for the CFSP device. The plasma temperature for the CFSP device was calculated to be 7260 Kelvin, whereas the temperature of a conventional plasma in an Optima 2000 was calculated to be about 6918 Kelvin. By introducing the sample in a counter flow, the temperature of the plasma decreased to a lesser degree than the temperature decrease observed with the standard Optima configuration.

Example 6—CFSP Device with Helical Load Coil

A device similar to the one described in Example 2 was used except that the flat plate coils were replaced with a using a 2.5 turn 3/16" copper tubing load coil, the same as the one used on the standard Optima 2000 set up. Whereas Example 2 used a single gas inlet torch (Aux only), the device used in this Example 6 was a dual gas inlet device (Aux and Plasma).

The sample conditions were as follows: for the normal configuration (Optima 2000), a 2.5 turn 3/16" helical coil was used with a power of 1523 Watts, a plasma gas flow rate of 15 L/minute, a nebulizer flow rate of 0.85 L/minute, an auxiliary gas flow rate of 0.2 L/minute and 1.5 mL/min pump rate; for the CFSP setup-1, a 2.5 turn 3/16" helical coil was used with a power of 1585 Watts, a plasma gas flow rate of 10 L/minute, a nebulizer flow rate of 0.8 L/minute, an auxiliary gas flow rate of 1.1 L/minute and 1.5 mL/min pump rate; for the CFSP setup-2, a 2.5 turn 3/16" helical coil was used with a power of 1585 Watts, a plasma gas flow rate of 10 L/minute, a nebulizer flow rate of 0.8 L/minute, an auxiliary gas flow rate of 0 L/minute and 1.5 mL/min pump rate. The background signals using the test device and the improvement factor (as compared to the signal from an Optima 2000 XL device) are shown in Table V below.

TABLE V

| Baseline Data of Standard Configuration | | CFSP Setup - 1 | | CFSP Setup - 2 | |
|---|---|---|---|---|---|
| element - wavelength | DL (ppb) | DL (ppb) | Factor better than normal configuration | DL (ppb) | Factor better than normal Configuration |
| As 188.979 | 5.684 | 3.7202 | 1.5 | 5.058 | 1.1 |
| As 193.696 | 10.119 | 6.9177 | 1.5 | 5.120 | 2.0 |
| Se 196.026 | 13.985 | 12.6832 | 1.1 | 3.514 | 4.0 |
| Cd 214.440 | 0.303 | 0.0655 | 4.6 | 0.169 | 1.8 |
| Pb 220.353 | 1.652 | 0.2870 | 5.8 | 0.518 | 3.2 |
| Cd 226.502 | 0.154 | 0.0792 | 1.9 | 0.026 | 6.0 |
| Zn 206.200 | 0.184 | 0.1821 | 1.0 | 0.349 | 0.5 |
| Cu 224.700 | 13.422 | 0.1581 | 84.9 | 0.269 | 49.9 |
| Mn 257.610 | 0.096 | 0.0031 | 30.6 | 0.006 | 15.4 |
| Mg 280.271 | 0.012 | 0.0008 | 14.6 | 0.003 | 3.8 |
| Mg 285.213 | 0.048 | 0.0046 | 10.6 | 0.016 | 3.0 |
| Cu 324.752 | 0.081 | 0.0108 | 7.5 | 0.064 | 1.3 |

As shown in Table V, the detection limit improved or was the same for all elements tested in both CFSP configurations except for zinc in the second configuration.

When introducing elements of the examples disclosed herein, the articles "a," "an," "the" and "said" are intended to mean that there are one or more of the elements. The terms "comprising," "including" and "having" are intended to be open ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A system comprising:

a torch configured to sustain an inductively coupled plasma in the torch, wherein the torch comprises a single gas inlet in an outer body of the torch, wherein the torch is configured to introduce a plasma gas through the single gas inlet in a flow that is substantially parallel to a longitudinal axis of an outer body of the torch, wherein the single gas inlet is positioned at a first end of the torch;

an induction device comprising an aperture configured to receive the torch and configured to provide radio frequency energy into the torch to sustain the inductively coupled plasma in the torch; and a sample introduction device fluidically coupled to the torch and configured to provide a sample fluid flow to the torch in a direction that opposes the flow of the plasma gas in the torch that is used to sustain the inductively coupled plasma to introduce analyte in the sample fluid flow into the sustained inductively coupled plasma to ionize the introduced analyte, wherein the sample introduction device is configured to introduce the sample flow into the torch at a second end of the torch that is opposite the first end of the torch.

2. The system of claim 1, in which the sample introduction device comprises a nebulizer.

3. The system of claim 1, further comprising a detector configured to receive a signal from the torch.

4. The system of claim 3, in which the detector is configured to detect optical absorption or optical emission of ionized analyte in the torch or exiting the torch.

5. The system of claim 1, further comprising a mass analyzer fluidically coupled to the torch.

6. The system of claim 1, in which the induction device comprises an induction coil.

7. The system of claim 1, in which the induction device comprises a plate electrode.

8. The system of claim 1, in which the induction device comprises an induction coil comprising a radial fin.

9. The system of claim 1, further comprising a radio frequency generator electrically coupled to the induction device.

10. The system of claim 1, in which the torch is configured to sustain the inductively coupled plasma using a total gas flow rate of less than 10 L/minute.

11. The system of claim 1, in which the torch comprises a port at the second end of the torch that is fluidically coupled to the sample introduction device, in which the port is non-parallel to the longitudinal axis of the torch.

12. The system of claim 11, in which the port is substantially perpendicular to the longitudinal axis of the torch.

13. The system of claim 1, in which the system further comprises a mass spectrometer fluidically coupled to the torch.

14. The system of claim 1, further comprising a processor electrically coupled to the sample introduction device.

15. The system of claim 1, in which the torch is configured to sustain the inductively coupled plasma in an auxiliary only mode with the single gas inlet of the outer body positioned perpendicular to the longitudinal axis of the torch.

* * * * *